United States Patent [19]

Oda et al.

[11] Patent Number: 4,585,621

[45] Date of Patent: Apr. 29, 1986

[54] VAPOR-DEPOSITED FILM OF SELENIUM OR SELENIUM ALLOY FOR ELECTROPHOTOGRAPHY

[75] Inventors: Osamu Oda; Arata Onozuka; Akio Koyama, all of Toda, Japan

[73] Assignee: Nihon Kogyo Kabushiki Kaisha, Tokyo, Japan

[21] Appl. No.: 626,500

[22] Filed: Jun. 29, 1984

[30] Foreign Application Priority Data

Nov. 10, 1983 [JP] Japan ..... 58-209977

[51] Int. Cl.[4] ..... G03G 5/082

[52] U.S. Cl. ..... 420/579; 430/86; 430/95; 252/501.1

[58] Field of Search ..... 420/579; 430/85, 86, 430/95; 252/501.1

[56] References Cited

U.S. PATENT DOCUMENTS 3,941,591 3/1976 Hanada ..... 96/1.5

4,415,642 11/1983 Elsasser et al. ..... 430/86

FOREIGN PATENT DOCUMENTS 40258 3/1982 Japan .

*Primary Examiner*—Christopher W. Brody

*Attorney, Agent, or Firm*—Seidel, Gonda, Goldhammer & Abbott

[57] ABSTRACT

A vapor-deposited film of selenium or selenium alloy as a photoreceptor for electrophotography comprises selenium or a selenium alloy and phosphorus contained therein in an amount of not less the 0.5 ppm and adjusted to attain a desired contrast potential. The selenium alloy is selected from Se-Te, Se-As, Se-Bi, and Se-Sb alloys. The film is produced either by adding phosphorus to stock selenium or selenium alloy and then vacuum-depositing the phosphorus-containing selenium or selenium alloy or by simultaneously vapor-depositing selenium or selenium alloy and elemental phosphorus or a phosphorus compound.

2 Claims, 2 Drawing Figures

VAPOR-DEPOSITED FILM OF SELENIUM OR SELENIUM ALLOY FOR ELECTROPHOTOGRAPHY

BACKGROUND OF THE INVENTION

This invention relates to a vapor-deposited film of selenium or selenium alloy as a photoreceptor for electrophotography and also to a process for producing the same, characterized in that the contrast potential of the resulting photoreceptor is controlled by doping the selenium or selenium alloy with phosphorus.

Electrophotography is a photocopying process which utilizes the photoconductivity and electrostatic behavior of certain substances. Of some methods so far established, one known as the Xerox process, or xerography, involves the use of a vapor-deposited film of selenium as a photoreceptor and the transfer of image for printing as an electronic photograph. The process comprises the steps of:

(a) charging, in which the surface of a photosensitive plate, consisting of an amorphous selenium layer with a high dark resistance vapor-deposited on a metal substrate, is electrostatically charged;

(b) exposure (printing), in which, upon exposure to an optical image, the areas of selenium irradiated with the light undergo a decrease in the electric resistance, the electrostatic charge escapes from the surface to the metal substrate, and the residual charge density on the photosensitive plate varies according to the amounts of exposure, thus forming an electrostatic latent image of the same pattern as the original copy on the selenium surface;

(c) development, in which a mixed powder of a toner, consisting of fine resin-coated carbon particles, and a carrier, consisting of microspheroidal glass, is dusted over the photosensitive plate surface, so that the toner adheres to the latent image and makes it visible;

(d) transfer, in which a sheet of appropriate paper is placed over the developed photosensitive plate surface, and the back of the paper is charged by the use of a corona discharge, whereby the toner on the photosensitive plate is attracted to the paper and the toner powder image is transferred onto the paper; and (e) fixing, in which the paper onto which the image has been transferred is removed from the photosensitive plate surface and is heated by an infrared heater to fuse and deposit the toner resin permanently onto the paper.

Through the practice of a sequence of these steps a reproduced image (electronic photograph) of the original is obtained. Clearness of the copied image, or the reproducibility of the original, is largely dependent on the performance of selenium as the photoreceptor. For the evaluation of the photoreceptor performance, apparently useful measures include: (i) the corona charge characteristic which represents the quantity of the electrostatic charge produced by a corona discharge of a given output; (ii) the dark decay characteristic related to the loss of charge while the photoreceptor, charged by the corona discharge, is held in the dark; (iii) charged potential decrease characteristic on exposure which represents the rate at which the charge held in darkened conditions disappears upon exposure; and (iv) residual potential which represents the potential that remains, instead of reduction to naught, after the exposure of the photoreceptor. For the adoption of selenium as a photoreceptor for a copying machine the color tone of the copy is an important determinant. The tone, in turn, depends to a large measure on the contrast potential, or the potential difference between the surface exposed to light and the non-exposed surface. For the tone control, therefore, control of the contrast potential, or control of the residual potential in the exposed region, is important.

Attempts have been made to add varied impurities to selenium in order to improve its electrophotographic properties. The impurities reported to have hitherto been added for that purpose are Te, As, Si, Sb, halogens, Cu, Ag, Zn, and the like. The additives have been primarily intended to:

(1) enhance the sensitiveness of selenium in the long-wave range, (2) reduce the residual potential toward zero, and (3) improve the mechanical strengths and wear resistance.

The prior attempts have, however, failed to control as desired the contrast potential of the selenium photoreceptor by the addition of such impurities.

SUMMARY OF THE INVENTION

It is an object of the present invention to provide a selenium or selenium alloy photoreceptor for electrophotography having a contrast potential so adjusted that a photoreceptor exhibiting a desired level of tone is offered to meet the requirement of copying machine users.

It has now been found that the addition of phosphorus to selenium or a selenium alloy results in a substantial change in the residual potential of the photoreceptor upon electrostatic charging, whether positively or negatively. The residual potential changes gradually over a range of about 300 V with the addition of phosphorus from zero up to, e.g., 1,000 ppm. In other words, the contrast potential varies gradually at an almost constant rate with the amount of phosphorus added. By preparing the diagram showing the correlation between the amount of phosphorus added to selenium or a selenium alloy and the contrast potential of the resulting photoreceptor, the phosphorus amount to be added may be selected corresponding to the contrast potential that produces the desired tone.

Thus, the present invention provides a vapor-deposited film of selenium or selenium alloy as a photoreceptor for electrophotography characterized in that said selenium or a selenium alloy contains phosphorus in an amount of not less than 0.5 ppm and adjusted for a desired contrast potential. The invention also provides a process for producing a vapor-deposited film of selenium or selenium alloy as a photoreceptor for electrophotography, which process comprises either adding phosphorus to stock selenium or selenium alloy and then vacuum-depositing the phosphorus-containing selenium or selenium alloy on a substrate or simultaneously vapor-depositing the selenium or selenium alloy and elemental phosphorus or a phosphorus compound to form a vapor-deposited film with a phosphorus content of not less than 0.5 ppm. The upper limit of the phosphorus content is desired to be 1,000 ppm in consideration of possible effects on other properties of the resulting photoreceptor.

DETAILED DESCRIPTION

The present invention will be described in more detail below.

Figure 1:
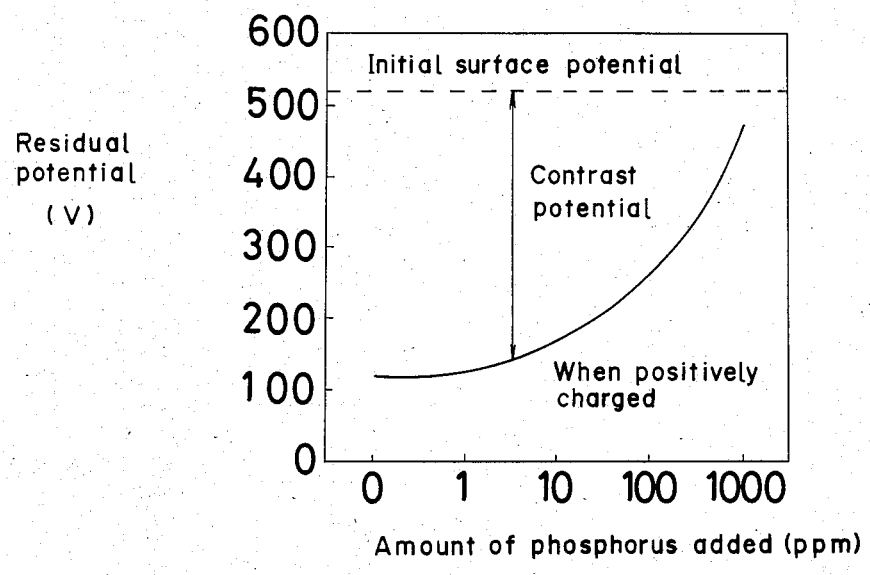
FIGS. 1 and 2 are graphs showing changes in the residual potential of photoreceptor with the addition of varied amounts of phosphorus being electrostatically charged, positively and negatively, respectively.
Figure 2:
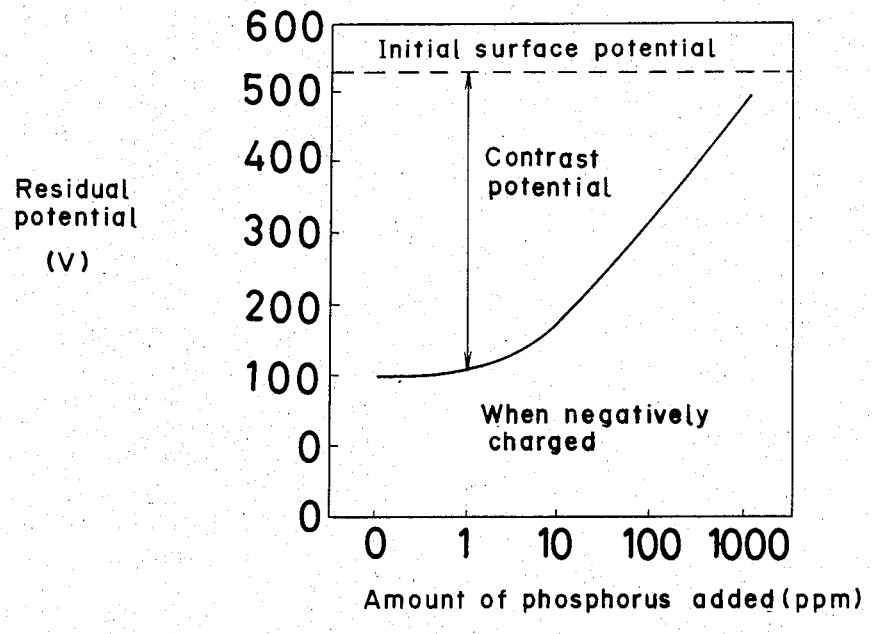

As stated above, the addition of phosphorus to selenium of a selenium alloy causes a marked change in the contrast potential of the resulting photoreceptor statically charged, whether it is positively charged or negatively charged. FIGS. 1 and 2 show, respectively, the relations between the residual potential after irradiation with light and the amount of phosphorus added to photoreceptors charged positively and negatively. In both cases the data plotted cover the residual potential after irradiation with light of 10 lux for 15 seconds. (For more details, refer to Examples.) The term "contrast potential" is herein defined as the differential between initial and residual surface potentials when the dark decay is ignored (this being permissible because the dark decay is little affected by phosphorus). As can be seen from these graphs, the residual potential can be gradually raised along a gentle curve with the increase in the amount of phosphorus being added, whether the photoreceptor is charged positively or negatively. This indicates that the control of the phosphorus content in the selenium or selenium alloy makes possible the control of the contrast potential and hence the free choice of the copy tone. Because of the growing demand for both positive- and negative-charged reproduction systems in recent years, this ability of controlling the residual potential through the addition of phosphorus in either case of positive or negative charging is a great advantage to the present-day photoreceptors for electrophotographic reproduction.

Under the invention, not merely elemental selenium but also selenium alloys in common use as photoreceptors for copying machines may be used. Examples are Se-Te, Se-As, Se-Bi, and Se-Sb alloys.

The stock selenium to be employed in the invention is preferably one purified by $SO_2$ reduction, vacuum distillation or other similar technique to a purity of about 6N (99.9999%).

The invention can be practiced by vapor-depositing a phosphorus-containing selenium or selenium alloy as a vaporizing source. Among the methods of adding phosphorus to selenium or selenium alloy are:

(1) Melting a mixture of elemental phosphorus or a phosphorus compound and selenium in an evacuated ampule or a hermetically sealed container.

(2) Melting selenium or a selenium alloy in an atmosphere of phosphine or other volatile phosphorus compound.

(3) Vacuum distillation of selenium or a selenium alloy in an atmosphere of phosphine or other volatile phosphorus compound.

The invention can be practiced as well as by simultaneously vapor-depositing elemental phosphorus or a phosphorus compound and selenium or a selenium alloy as separate vaporizing sources.

When a phosphorus-containing selenium vaporizing source for vapor depositing is to be used, it is important to add more phosphorus to the vaporizing source selenium than the required phosphorus content in the resulting vapor-deposited film. This is necessary because not all phosphorus in the vaporizing source selenium but a portion of it is transferred to the resulting film.

The conditions for vacuum deposition operation are not critical; conventionally employed conditions will serve the purposes of the invention.

For example, the substrate to carry the vapor-deposited film of selenium or selenium alloy may be aluminum, copper, or other metal, metallized paper or plastics, or the like.

The vaporizing-source temperature may be suitably chosen from the range of 250° to 350° C.; the substrate temperature, from 55° to 70° C.; the degree of vacuum, from $10^{-5}$ to $10^{-6}$ torr; and the deposition time, from 60 to 130 minutes.

EXAMPLE 1

A selenium having a purity of 6N with the impurities shown in Table 1 was used in experiments to determine the effects of phosphorus upon electrophotographic properties of selenium.

TABLE 1

| Impurity: | Te | Sb | Cu | Pb | Zn | Fe | Ni | Hg | O |
|---|---|---|---|---|---|---|---|---|---|
| Content: (ppm) | <0.01 | <0.01 | <0.01 | <0.01 | <0.03 | <0.05 | <0.01 | <0.05 | <2 |

Varied amounts of phosphorus were added to portions of the high-purity selenium, and the mixture were ampuled under a vacuum for doping, and their properties were evaluated. For the doping a rocking furnace was employed and the selenium was doped with phosphorus by melting at 500° C. for 15 hours.

These test mixtures were vapor-deposited by resistance heating on 55 mm-square mirror-finished pieces of aluminum substrate.

The conditions used for the vapor deposition were as below:

Vaporizing-source temperature=270° C.
Substrate temperature=60° C.
Degree of vacuum=$2\times10^{-6}$ torr
Deposition time=60 min.

The selenium films thus formed on the aluminum substrates were all 50 μm thick.

The vapor-deposited selenium films thus obtained were tested, by means of an electrostatic testing instrument, for their photoelectric characteristic (residual potential) values under the following conditions:

Corona discharge voltage=5 kV
Light attenuation time=1.5 sec.
Illuminance for exposure=20 1×
Illuminance & time for destaticization=20,000 1×, 2 sec.
No. of repetitions=50

The relationship between the residual potential after 1.5 seconds of irradiation with light under the above conditions and the amount of phosphorus added is graphically represented in FIGS. 1 and 2. It will be understood that, whether the photoreceptors are positively or negatively charged, the residual potential rises moderately at a relatively constant rate with the increase in the amount of phosphorus added.

EXAMPLE 2

Selenium and phosphorus, contained in separate vaporizing crucibles, were simultaneously evaporated by resistance heating to form a 50 μm-thick film on a mirror-finished Al substrate. While the conditions for vapor deposition of selenium were the same as in the preceding example, the phosphorus vaporizing-source temperature was controlled within a range of 50°–200° C. so that the phosphorus content in the film was varied. The results of experiments with such films indicated that the residual potential rises as the phosphorus content increases, again as shown in FIGS. 1 and 2.

As has been described above, the present invention depends on controlled addition of phosphorus for the adjustment of color tones of photocopies to best suit the user requirements. In this way the invention is expected to play an important role in the field of copying machines that have to meet ever diversifying demands.

What is claimed is:

1. A vapor-deposited film of selenium or selenium alloy as a photoreceptor for electrophotography characterized in that said selenium or a selenium alloy contains phosphorus therein in an amount of not less than 0.5 ppm and not more than 1,000 ppm and adjusted to attain a desired contrast potential.

2. A vapor-deposited film according to claim 1, wherein said selenium alloy is selected from Se-Te, Se-As, Se-Bi, and Se-Sb alloys.

* * * * *